United States Patent [19]

Kurtz et al.

[11] Patent Number: 4,655,578

[45] Date of Patent: Apr. 7, 1987

[54] REPRODUCING APPARATUS CARTRIDGE MOUNTING ASSEMBLY

[75] Inventors: Robert L. Kurtz, Fairport; John F. Whiting, Webster, both of N.Y.

[73] Assignee: Xerox Corporation, Stamford, Conn.

[21] Appl. No.: 842,957

[22] Filed: Mar. 24, 1986

[51] Int. Cl.[4] ..... G03G 15/00

[52] U.S. Cl. ..... 355/3 R; 355/3 DR; 355/3 BE; 355/3 DD

[58] Field of Search ..... 355/3 R, 3 DR, 3 BE, 355/3 DD, 16

[56] References Cited

U.S. PATENT DOCUMENTS

| | | | |
|---|---|---|---|
| 3,985,436 | 10/1976 | Tanaka et al. | 355/8 |
| 4,386,839 | 6/1983 | Kumagai et al. | 355/3 DR |
| 4,386,841 | 6/1983 | Wakao et al. | 355/3 DR |
| 4,460,267 | 7/1984 | Ogawa | 355/3 DD |
| 4,462,677 | 7/1984 | Onoda | 355/3 R |
| 4,470,689 | 9/1984 | Nomura et al. | 355/3 R |
| 4,470,690 | 9/1984 | Hoffman | 355/3 BE |
| 4,497,570 | 2/1985 | Bolte et al. | 355/16 |
| 4,544,260 | 10/1985 | Kolbe | 355/3 BE |
| 4,556,308 | 12/1985 | Hoppner et al. | 355/3 R |
| 4,561,763 | 12/1985 | Basch | 355/3 DR |
| 4,591,258 | 5/1986 | Nishino et al. | 355/3 R |

*Primary Examiner*—A. C. Prescott

[57] ABSTRACT

A cartridge assembly including a processing cartridge removable therefrom for use with and insertion into an electrostatographic reproducing apparatus is provided. The assembly includes a cartridge frame together with at least one electrostatographic processing unit such as a photoreceptor belt which has a portion outwardly exposed relative to the cartridge for performing its processing function when inserted in the copier which is susceptible to deterioration or damage, a removable rigidly conformable protective sheath like member wrapped around the cartridge having around the periphery of one end protecting the insertion end of the cartridge one element of a two element coupling which is engagably mateable with the other element of the two element coupling at the cartridge insertion position of the copier and means to slidably urge the cartridge through the sheath into the reproducing machine when the coupling element on the end of the sheath is engagably mated with the coupling element on the copier whereby the processing cartridge may be inserted in the copier without deterioration or damage. In a preferred embodiment the two element coupling comprises a male lip around the periphery of the sheath which is engagable with a female coupling collar on the main apparatus and a lever is provided movable within a slot in the sheath actuatable from outside the sheath to urge the cartridge into the processing position.

11 Claims, 7 Drawing Figures

REPRODUCING APPARATUS CARTRIDGE MOUNTING ASSEMBLY

BACKGROUND OF THE INVENTION

The present invention relates to electrostatographic reproducing apparatus and more particularly to a mounting assembly for mounting a removable processing cartridge to the main frame of the reproducing apparatus.

In the electrostatographic reproducing apparatus commonly in use today, a photoconductive insulating member is typically charged to uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas in the photoconductive insulating area to form a powder image on the photoconductive area. This image may subsequently be transferred to a support surface such as copy paper to which it may be permanently affixed by heating or by the application of pressure.

In order to minimize maintenance costs by permitting the operator to replace worn out or exhausted processing units in electrostatographic apparatus it has been suggested to incorporate one or more processing units of the apparatus in a disposable or removable cartridge. In this way the operator can readily remove the cartridge when its operational life has been exhausted and insert a new cartridge. Since the replaceable processing unit contains one or more elements which are highly susceptible to damage or deterioration it is important that they be protected prior to and during the replacement operation. For example, if the operator's fingers contact the photoreceptor surface they may deposit grease or oil on the surface which will in some way inhibit the subsequent transfer of toner to paper thereby essentially destroying the functionality of the photoreceptor. In addition certain photoreceptors are highly sensitive to light requiring changing in the dark to avoid unnecessary overexposure. In some way when exposed for extended periods of time the light may have an adverse affect on the overall life of the photoreceptor. Furthermore, without some protection it is possible that the photoreceptor as well as other process units be subjected to the possibility of other physical damage if they are not adequately protected.

PRIOR ART

U.S. Pat. No. 3,985,436 to Tanaka et al. describes a replaceable cartridge for use in electrostatographic imaging apparatus which contains a photoreceptor, a developing device and a cleaning device as well as a corotron which may be releasably inserted into the copying machine. This cartridge is positioned in the machine by being inserted from one side thereof and having cooperative elements on the cartridge which are guided by guidemembers of the main frame of the machine.

U.S. Pat.'s No. 4,556,308 to Hoppner et al. and U.S. Pat. 4,544,260 to Colby illustrate removable processing cartridges containing photoreceptor belts which may be inserted in the operational position in the machine when the top of the machine is opened up.

An approach similar to that described above with reference to U.S. Pat. No. 3,985,436 has been commercially employed in the Canon PC 10/20 wherein a plastic molded cartridge containing a photoreceptor drum together with other elements including the developer housing and cleaner assembly are inserted from the side of the machine on essentially horizontal guidemembers to guide the cartridge into its final position in the machine. The Canon PC 10/20 has a rigid molded plastic handle on one side.

U.S. Pat. No. 4,462,677 Onada describes a processing cartridge including a protection cover for a photoreceptor which is movable between a closed protection position and an open operational position in association with opening up passage for the image receiving material. U.S. Pat. No. 4,470,689 to Mormora et al. also describes a detachably mounted processing unit including an imagebearing member and a protection cover therefore which is movable to the closed position in association with separation of the process unit from the operative position in the main assembly. U.S. Pat. No. 4,460,267 also describes a removable processing unit, in particular a developer device with a movable shutter which is in the open position when the developing device is mounted in the imageforming apparatus and is at a closed position when the developing device is demounted from the imageforming apparatus.

In addition to the above types of protective measures it has also been proposed to provide a complete wraparound for the removable processing cartridge which has to be removed either before insertion of the cartridge in the main apparatus assembly or after insertion in the main apparatus assembly. If it is removed before insertion the difficulty with regard to damage as a result of light, fingerprints or physical damage as described above is of course present. If such a protective wraparound is removed after cartridge insertion typically a very cumbersome operation is involved and one which is intimidating to the operator in that they must stick their hand or arm into the machine. In addition this technique typically requires increased machine volume to facilitate the users hand or arm.

Accordingly it is a principle aspect of the present invention to provide a removable processing unit for electrostatographic reproducing apparatus which has a protective member which is automatically removable therefrom upon insertion of the processing cartridge into the main assembly of the reproducing apparatus.

SUMMARY OF THE INVENTION

The present invention is directed to an assembly including a processing cartridge removable therefrom for use with and insertion into an electrostatographic reproducing apparatus which comprises a cartridge frame assembly supporting at least one electrostatographic processing unit having at least a portion thereof outwardly exposed relative to the cartridge for performing its processing function when inserted in the reproducing apparatus with the exposed portion being susceptible to deterioration or damage by being so exposed, a removable rigidly conformable protective sheath like member wrapped around said cartridge and containing said cartridge therein, said sheath like member having around the periphery of one end protecting the insertion end of the cartridge one element of a two element coupling which is engagably mateable with the other element of the two element coupling at the cartridge insertion position of said reproducing apparatus and means to slideably urge said cartridge through said sheath into said reproducing machine when said one element on said sheath is engagably mated with said coupling element on said reproducing apparatus whereby said processing cartridge is inserted in said reproducing apparatus without deterioration or damage.

In a specific aspect of the present invention the processing cartridge comprises a imaging member in the form of an endless belt having a photoconductive insulating surface.

In a further aspect of the present invention the coupling element on the sheath comprises a male lip around the periphery of the sheath which is engagable with a female coupling collar on the reproducing apparatus.

In a further aspect of the present invention a lever is provided which is movable within a slot in the sheath actuateable from the outside and engageable with the outboard end of the cartridge for insertion of the cartridge through the sheath into the reproducing machine.

In a further aspect of the present invention an electrostatographic reproducing apparatus comprising a main frame is provided a coupling collar which is engagable with a coupling on the protective sheath of the removable cartridge so that the cartridge may be removed from the protective sheath and inserted in its operational position in the reproducing apparatus without being damaged.

BRIEF DESCRIPTION OF THE DRAWINGS

The FIG. 1 is a schematic representation in cross section of an automatic electrostatographic reproducing machine employing a processing cartridge which may be inserted thereinto according to the present invention.

FIG.'s 5*a*, 5*b*, and 5*c* are alternative embodiments wherein more than one electrostatographic processing unit may be included within the processing cartridge.

DESCRIPTION OF THE PREFERRED EMBODIMENT

The invention will now be described with reference to preferred embodiment of the processing cartridge assembly in an electrostatographic reproducing apparatus employing same.

Figure 1:
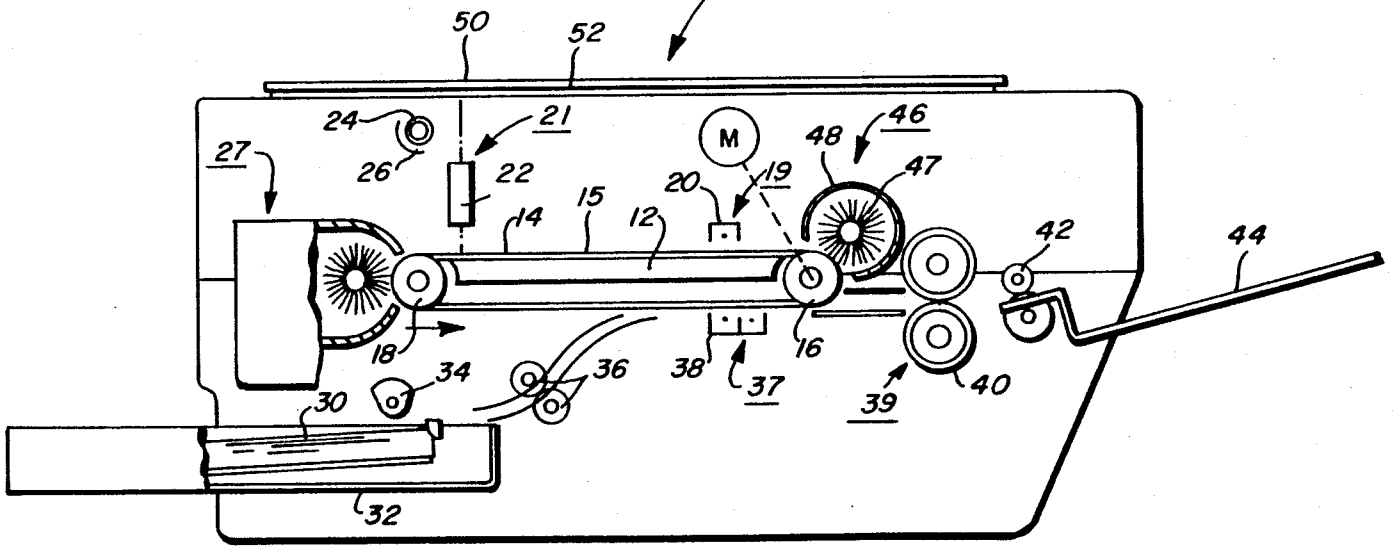

Referring now to FIG. 1, there is shown by way of example, an automatic electrostatographic reproducing machine 10 which includes a removable processing cartridge comprising a photoreceptor belt according to the present invention. The reproducing machine depicted in FIG. 1 illustrates the various components utilized therein for producing copies from an original document. Although the apparatus of the present invention is particularly well adapted for use in automatic electrostatographic reproducing machines, it should become evident from the following description that it is equally well suited for use in a wide variety of processing systems including other electrostatographic systems and is not necessarily limited in application to the particular embodiment or embodiments shown herein.

The reproducing machine 10 illustrated in FIG. 1 employs a removable processing cartridge 12 which may be inserted and withdrawn from the main machine frame from the front. Cartridge 12 includes an image recording belt like member 14 the outer periphery of which is coated with a suitable photoconductive material 15. The belt is suitably mounted for revolution within the cartridge about driven transport roll 16, and idler roll 18 and travels in the direction indicated by the arrow on the outer run of the belt to bring the image bearing surface thereon past the plurality of xerographic processing stations. Suitable drive means such as motor 17 are provided to power and coordinate the motion of the various cooperating machine components whereby a faithful reproduction of the original input scene information is recorded upon a sheet of final support material 30, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter the belt 14 is driven to exposure station 21 wherein the charged photoconductive surface 15 is exposed to the light image of the original input scene information, whereby the charge is selectively dissipated in the light exposed regions to record the original input scene in the form of electrostatic latent image. The exposure station 21 may comprise a bundle of image transmitting fiber lenses 22 produced under the tradename of "SELFOC" by Nippon Sheet Glass Company Limited, together with an illuminating lamp 24 and a reflector 26. After exposure of the belt 15 the electrostatic latent image recorded on the photoconductive surface 15 is transported to development station 27, wherein developer is applied to the photoconductive surface of the drum 15 rendering the latent image visible. Suitable development station could include a magnetic brush development system including developer roll 28, utilizing a magnetizable developer mix having course magnetic carrier granules and toner colorant particles.

Sheets 30 of the final support material are supported in a stack arrangement on elevated stack support tray 32. With the stack at its elevated position, the sheet separator segmented feed roll 34, feeds individual sheets thereform to the registration pinch roll pair 36. The sheet is then forwarded to the transfer station 37 in proper registration with image on the belt and the developed image on the photoconductive surface 15 is brought into contact with the sheet 30 of final support material within the transfer station 37 and the toner image is transferred from the photoconductive surface 15 to the contacting side of the final support sheet 30 by means of transfer corotron 38. Following transfer of the image, the final support material which may be paper, plastic, etc., as desired, is separated from the belt by the beam strength of the support material 30 as it passes around the arcuate face of the roll 16, with the sheet containing the toner image thereon which is advanced to fixing station 39 wherein roll fuser 40 fixes the transferred powder image thereto. After fusing the toner image to the copy sheet, the sheet 30 is advanced to output rolls 42 to sheet stacking tray 44.

Although a preponderance of toner powder is transferred to the final support material 30, invariably some residual toner remains on the photoconductive surface 15 after the transfer of the toner powder image to the final support material. The residual toner particles remaining on the photoconductive surface after the transfer operation are removed from the belt 14 by the cleaning station 46 which comprises a rotatable cleaning brush 47 in wiping contact with the outer periphery of the belt 14 and contained within cleaning housing 48. Alternatively, the toner particles may be cleaned from the photoconductive surface by a cleaning blade as is well known in t Normally when the copier is operated in the conventional mode, the original document 50 to be reproduced is placed image side down upon a horizontal transport viewing platen 52 which transports the original past the exposure station 21. The speed of the moving platen and the speed of the photoconductive belt are synchronized to provide a faithful reproduction of the original document.

It is believed that the foregoing general description is sufficient for the purposes of the present application to illustrate the general operation of an automatic xerographic copier 10 which can be used in accordance with the present invention.

Figure 2:
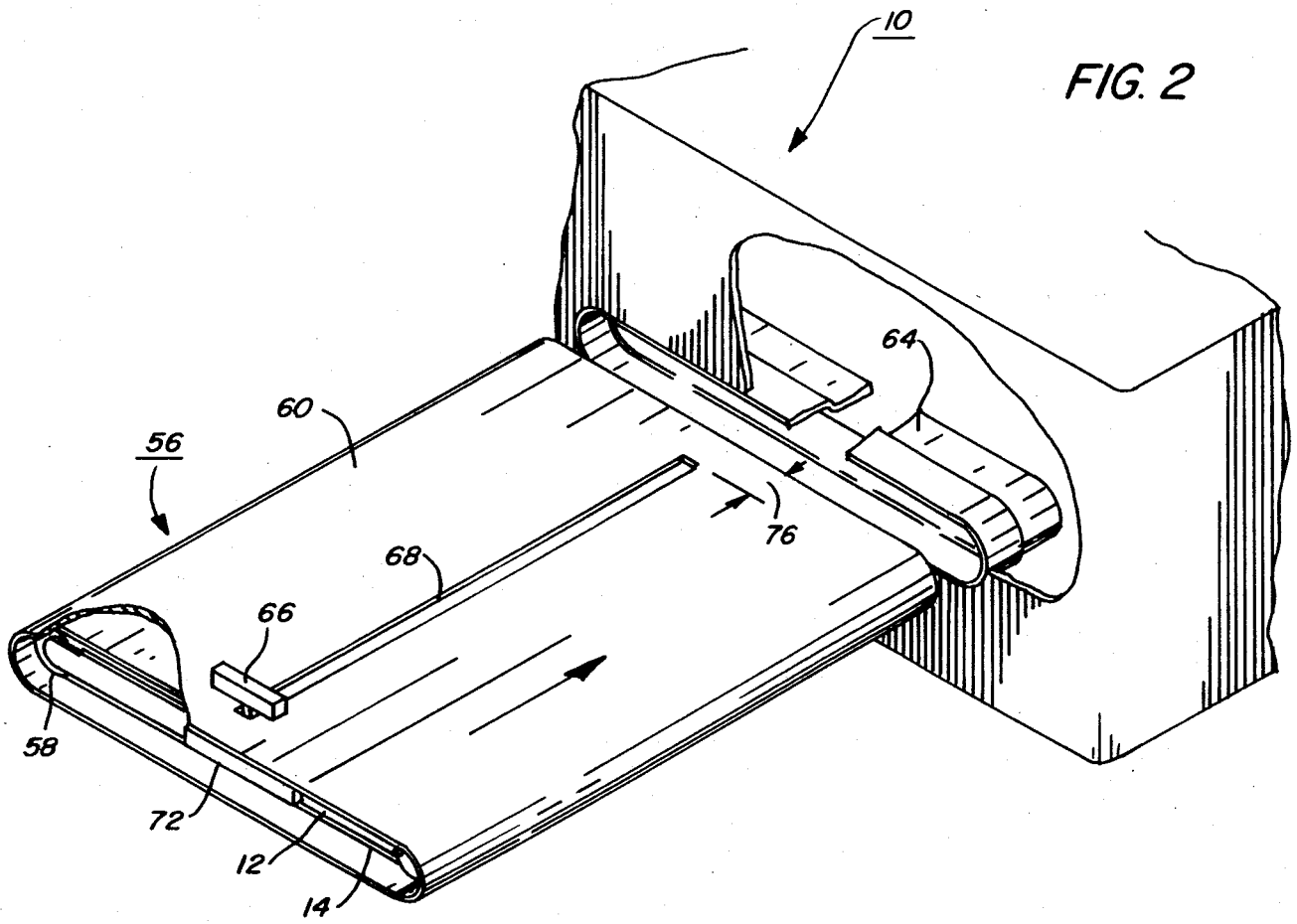
FIG. 2 is a partial isometric view showing the insertion of the processing cartridge into the mating collar on an automatic electrostatographic reproducing machine.
Figure 3:
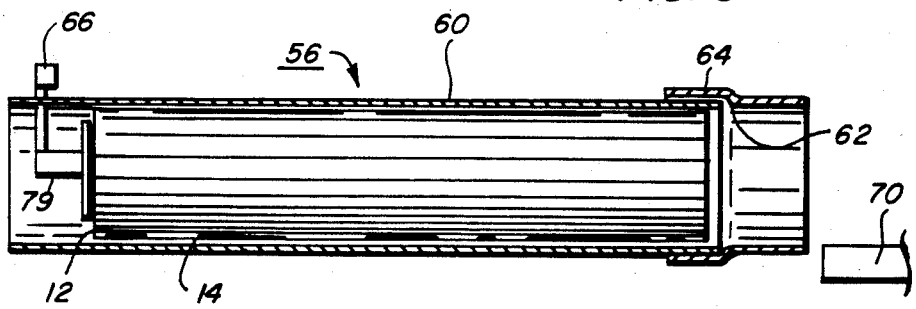
FIG. 3 is a schematic representation in cross section showing the cartridge assembly at the moment of insertion into the automatic electrostatographic reproducing machine and illustrating the elements of the two element coupling the cartridge assembly to the machine.

FIG'S. 2 and 3 illustrate both the construction of the processing cartridge assembly 56 together with its manner of operation on inserting the processing cartridge into electrostatographic reproducing machine. In FIGS. 2 and 3 the processing cartridge 12 includes a cartridge frame assembly 58 proporting an endless photoreceptor belt 14. A removable rigidly conformable protective sheath like member 60 is wrapped around the cartridge and contains the cartridge therein. The processing cartridge assembly 56 may be inserted toward the main frame of the reproducing device in the direction of the arrow indicated in FIG. 2. The processing cartridge assembly includes a male coupling lip 62 extending around the periphery of the sheath 60 at the insertion or inboard end of the cartridge. This coupling element or mating lip 62 is insertable into and mateable with the female coupling collar 64 on the main frame of the electrostatographic reproducing apparatus. The male lip 62 and female coupling collar 64 provide a two element coupling, which is engagably mateable at the cartridge insertion position on the main frame of the apparatus.

Once the two element coupling has been engaged the processing cartridge may be slideably urged through the sheath into the reproducing machine in any suitable manner. As illustrated in FIG'S. 2 and 3 an insertion lever 66 which is slideable in the sheath 60 through slot 68 and which engages the end of the processing cartridge by means of tab 74 may be manually moved in the direction of the arrow in FIG. 2 to urge the cartridge through the sheath into the main frame of the reproducing machine. Once the processing cartridge 12 enters the main frame of the reproducing machine it may be it is positioned in operative positioned by sliding along rails 70 in the main machine. Upon insertion into the operational position the photoreceptor belt drive mechanism is engagable with the drive mechanism on the main frame. The length of the insertion tab 74 should be equal to or greater than the distance 76 from the end of the slot to the end sheath so that the end of the sheath need not be cut during the insertion procedure. After the photoreceptor cartridge has been inserted in the main frame of the machine the insertion lever and the sheath may be withdrawn from the coupling collar and the machine used in the normal manner. When it is desired to replace the processing cartridge it may be extracted from the machine by pulling forward on handle 72 and a new processing cartridge inserted in the same way.

Figure 4:
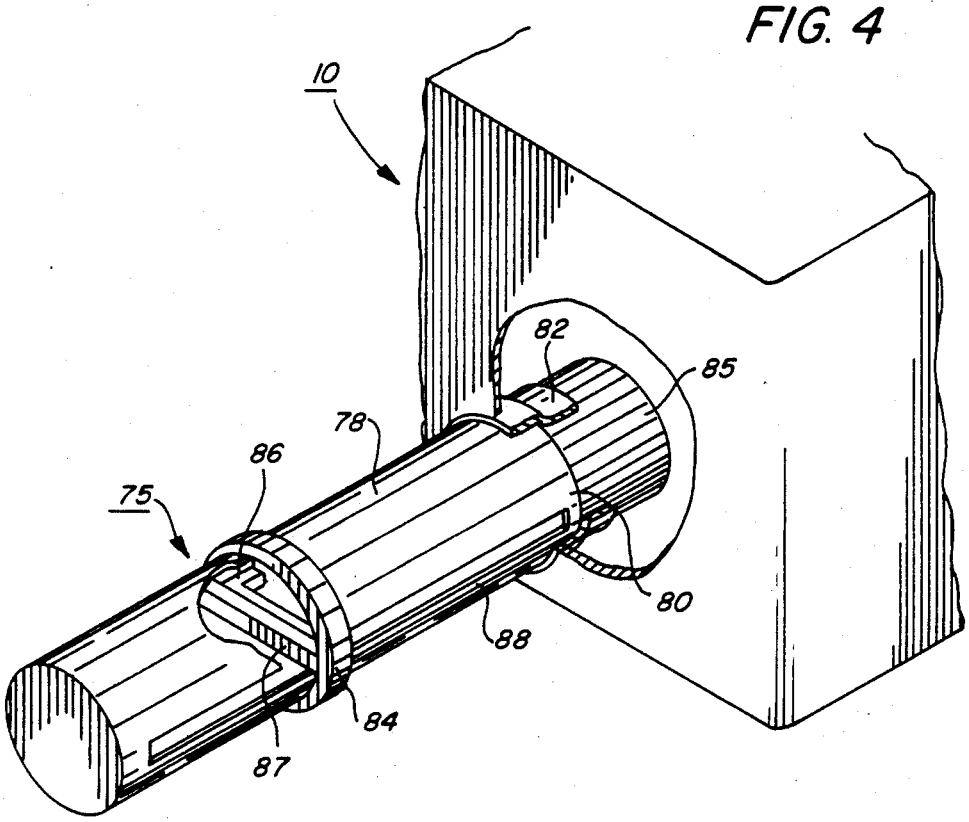
FIG. 4 is an alternative embodiment according to the present invention wherein the electrostatographic processing unit comprises a cylindrical drum.

FIG. 4 illustrates an alternative embodiment wherein the processing cartridge comprises a photoreceptor drum 85. Although the configuration is slightly different the manner of operation in principle is exactly the same as that described with reference to FIG'S. 2 and 3. In particular the processing cartridge assembly 75 includes a tubular sheath like member 78 having a mating lip 80 insertable into the female coupling collar 82 on the main frame. An insertion collar 84 rides around tubular sheath 68 and engages the outboard end of the drum 85 by means of two tabs 87 one on each side of the collar 84. When the collar is moved in the direction of the arrow the tabs 87 move toward the main frame in a pair of slots, 88, one on each side of the cylindrical sheath, to insert the photoreceptor drum contained within the processing cartridge assembly into the main frame. Once the processing drum has been inserted the protective sheath 78 may be withdrawn from the main frame. When it desired to replace the photoreceptor drum it may be removed from its operational position by means of extraction handle 86. In the embodiment illustrated in FIG. 4 with the insertion lever in the form of a collar around the whole protective sheath the forces are more evenly applied on insertion of the photoreceptor drum and therefore there is less likely to be any binding during the insertion operation.

The protective sheath should be sufficiently rigidly conformable to slide into the collar on the main machine and maintain a structural integrity during the cartridge insertion operation. The sheath which typically could be made from cardboard or plastic may also be placed on the processing cartridge at the moment of manufacture and if desired used as a shipping package. While the protective sheath may be in contact with the photoreceptor it is preferred that it be supported by the cartridge frame assembly to avoid any possible damage to the photoreceptor during the insertion operation. Furthermore while the insertion operation has been illustrated with reference to sliding the photoreceptor belt into its operational position it should be noted that it may inserted into a standby position wherein it is positioned slightly away from the remaining processing stations and subsequently moved to the processing location by any suitable means such as by a lever mechanism within the main frame of the reproducing apparatus.

The insertion collar on the main frame of the reproducing apparatus may be positioned flush, internal or outside of the machine frame or covers. It will be appreciated of course that asthetically it should be internal of the outer covers of the machine. While the two element coupling has been illustrated as comprising a male lip around the periphery of the protective sheath which is engagable with the female coupling collar on the reproducing apparatus it will be understood that any suitable coupling device coupling the processing cartridge assembly with the main frame of the reproducing apparatus may be employed. In the coupling device illustrated about one inch of the mating lip of the protective sheath is in engagement with about one inch of the female coupling collar on the main frame assembly. Furthermore while a means to slideably urge the cartridge through the sheath into the reproducing machine has been generally illustrated as comprising an insertion lever or insertion collar it will be understood that other means may be employed. For example, the handle illustrated in FIG. 2 on the belt cartridge could be used as the insertion device.

Figure 5A:
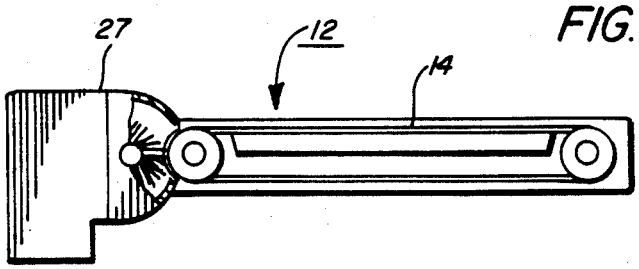
Figure 5B:
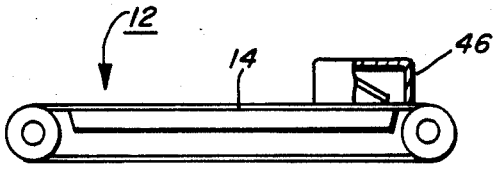
Figure 5C:
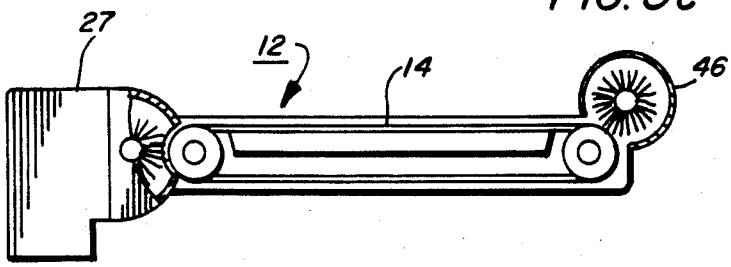

It will also be understood that while the processing cartridge has been illustrated as comprising a photoreceptor in either a belt or a drum configuration that other electrostatographic processing units may form part of the processing cartridge. In this regard attention is directed to FIG'S. 5*a*, 5*b*, and 5*c* wherein alternative embodiments are illustrated. In FIG. 5*a*, the processing cartridge 12 includes in addition to the photoreceptor belt, the developer housing 27. In FIG. 5*b*, the processing cartridge includes in addition to the photoreceptor belt 14 a cleaner housing 46 and in FIG. 5*c*, the processing cartridge 12 includes in addition to the photoreceptor belt both a developer housing 27 and a cleaner housing 46.

Thus according to the present invention an assembly has been provided including a processing cartridge removable from and mountable into the main frame of an electrostatographic reproducing apparatus, with a protective sheathlike member wrapped around the processing cartridge which during insertion into the apparatus provides an electrostatographic processing unit contained within the cartridge which has a portion thereof outwardly exposed and otherwise would be susceptible to deterioration or damage, is protected so that upon insertion it is not susceptible to deterioration or damage. The present insertion assembly is an inexpensive easy to manufacture and very easy to use and provides complete protection against damage. Furthermore it provides a self-aligning feature in that it can be manually inserted in the receptive collar on the main frame electrostatographic reproducing apparatus and the processing unit in the cartridge inserted directly into operational position.

The disclosures of the patents referred to herein are hereby specifically and totally incorporated herein by reference.

While the invention has been described with references specific embodiments it will be apparent to those skilled in the art that many alternatives and modifications and variations may be made. For example while the invention has been described with particular reference to electrostatographic copier apparatus it will be understood that it has equal application to electrostatographic printing apparatus. Accordingly it is intended to embrace all such alternatives and modifications as may fall within the spirit and scope of the appended claims.

What is claimed is:

1. An assembly including a processing cartridge removable therefrom for use with and insertion into an electrostatographic reproducing apparatus, said assembly comprising;

a cartridge frame assembly supporting at least one electrostatographic processing unit having at least a portion thereof outwardly exposed relative to the cartridge for performing its processing function when inserted in said reproducing apparatus, said exposed portion being susceptible to deterioration or damage by so being exposed;

a removable rigidly conformable protective sheath like member wrapped around said cartridge and containing said cartridge therein, said sheath like member having around the periphery of one end protecting the insertion end of the cartridge one element of a two element coupling which is engagably mateable with the other element of the two element coupling at the cartridge insertion portion of said reproducing apparatus; and means to slidably urge said cartridge through said sheath into said reproducing machine when said one element of said sheath is engagably mated with said coupling element on said reproducing apparatus, whereby said processing cartridge is inserted in said reproducing apparatus without deterioration or damage.

2. The assembly of claim 1 wherein said at least one electrostatographic processing unit comprises an imaging member.

3. The assembly of claim 2 further including at least one additional electrostatographic processing unit.

4. The assembly of claim 2 wherein said imaging member comprises an endless belt having a photoconductive insulating surface.

5. The assembly of claim 2 wherein said imaging member comprises a cylindrical drum having a photoconductive insulating surface.

6. The assembly of claim 1 wherein said one element of a two element coupling comprises a male lip around the periphery of the sheath which is engagable with a female coupling collar on the reproducing apparatus.

7. The assembly of claim 1 wherein said means to slidably urge said cartridge is movably mounted on said sheath.

8. The assembly of claim 7 wherein said means to slidably urge comprises a lever movable within a slot in said sheath, actuatable from the outside of said sheath and engagable with the outboard end of said cartridge within said sheath.

9. The assembly of claim 1 wherein said cartridge includes a handle at its outboard end.

10. Electrostatographic reproducing apparatus comprising a main frame and a removable processing cartridge containing at least one electrostatographic processing unit, said main frame including the remaining processing units to produce images, said main frame also including one element of a two element coupling at the cartridge insertion position of one outboard side, said one element being engagable with the other element of the two element coupling around the periphery of the inboard end of a removable rigidly conformable protective sheath like member wrapped around said cartridge when said cartridge is positioned for insertion in said main frame.

11. The apparatus of claim 10 wherein said one element of a two element coupling comprises a female coupling collar which is engagable with a male lip around the periphery of the inboard end of the sheath like member.

* * * * *